US009956466B2

(12) United States Patent
Fu et al.

(10) Patent No.: US 9,956,466 B2
(45) Date of Patent: May 1, 2018

(54) PUNCHING ELASTICITY ADJUSTMENT STRUCTURE

(71) Applicant: Tung-Chien Fu, New Taipei (TW)

(72) Inventors: Ton-Ki Fu, Taipei (TW); Tung-Chien Fu, New Taipei (TW)

(73) Assignee: Tung-Chien Fu, New Taipei (TW)

( * ) Notice: Subject to any disclaimer, the term of this patent is extended or adjusted under 35 U.S.C. 154(b) by 0 days. days.

(21) Appl. No.: 14/474,281

(22) Filed: Sep. 1, 2014

(65) Prior Publication Data

US 2014/0371037 A1 Dec. 18, 2014

Related U.S. Application Data

(63) Continuation of application No. 13/323,788, filed on Dec. 12, 2011, now Pat. No. 8,931,767.

(51) Int. Cl.

| | |
|---|---|
| ***F16F 7/00*** | (2006.01) |
| ***A63B 69/20*** | (2006.01) |
| *A63B 21/02* | (2006.01) |
| *A63B 21/00* | (2006.01) |

(52) U.S. Cl.

CPC ..... *A63B 69/208* (2013.01); *A63B 69/201* (2013.01); *A63B 21/00069* (2013.01); *A63B 21/02* (2013.01)

(58) Field of Classification Search

CPC ..... A63B 69/201; A63B 69/208; A63B 21/02; A63B 21/00069

See application file for complete search history.

(56) References Cited

U.S. PATENT DOCUMENTS

| | | | | | |
|---|---|---|---|---|---|
| 519,918 | A * | 5/1894 | MacLearn | A63B 69/208 | 482/90 |
| 547,731 | A * | 10/1895 | MacLearn | A63B 69/208 | 211/33 |
| 689,344 | A * | 12/1901 | Yoerger et al. | A63B 69/205 | 482/87 |
| 2,085,161 | A * | 6/1937 | Kraus | A63B 69/208 | 248/160 |
| 2,197,545 | A * | 4/1940 | Bachman | A63B 69/345 | 473/444 |
| 5,099,946 | A * | 3/1992 | Hirano | B60K 17/16 | 180/360 |
| 5,624,358 | A * | 4/1997 | Hestilow | A63B 69/208 | 482/83 |
| 5,921,895 | A * | 7/1999 | Lynch | A63B 69/004 | 482/83 |
| 6,090,018 | A * | 7/2000 | Laudenslager | A63B 69/201 | 482/83 |
| 7,704,194 | B1 * | 4/2010 | Chen | A63B 69/208 | 482/83 |

(Continued)

*Primary Examiner* — Melody M Burch
(74) *Attorney, Agent, or Firm* — Raymond Y. Chan; David and Raymond Patent Firm

(57) ABSTRACT

The present invention discloses an elasticity adjustment structure of physical training device which comprise one elastomer adjustment set; said elastomer adjustment set further comprises one first elastomer and one second elastomer. Overlapping the said second elastomer and said first elastomer with different rigidities at different depth positions to create a smooth elastic curve of said elastomer adjustment set; as a result the elasticity of said elasticity adjustment structure may be adjusted in accordance with different needs.

4 Claims, 19 Drawing Sheets

(56) References Cited

U.S. PATENT DOCUMENTS

| | | | | |
|---|---|---|---|---|
| 7,766,799 | B1 * | 8/2010 | Chen | A63B 69/208<br>482/85 |
| 2005/0046096 | A1 * | 3/2005 | Salis | F16F 3/12<br>267/33 |
| 2009/0264263 | A1 * | 10/2009 | Yang | A63B 69/0075<br>482/85 |
| 2013/0029811 | A1 * | 1/2013 | Lando | A63B 21/023<br>482/121 |
| 2013/0085044 | A1 * | 4/2013 | Chen | A63B 69/20<br>482/87 |

* cited by examiner

PUNCHING ELASTICITY ADJUSTMENT STRUCTURE

CROSS REFERENCE OF RELATED APPLICATION

This is a Continuation application that claims the benefit of priority under 35 U.S.C. § 119 to a non-provisional application, application Ser. No. 13/323,788, filed Dec. 12, 2011.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an elasticity adjustment structure of physical training device, particularly one that may adjust its elasticity to meet different needs of users.

Description of Related Arts

Principle of conventional martial training device is: one punching bag (such as speed ball or filler bag), when punched by external force, will swing back and forth utilizing elasticity of elastomer connecting to said punching bag.

The elasticity of elastomer of said physical training device is fixed so elastic strength cannot be adjusted for different needs.

Moreover, there is training device utilizing steel tube to change the elasticity of its elastomer. When the punching bag is impacted with external force, the elasticity curve of the said elastomer which it is connected to is not smooth enough. The stress is concentrated on the intersection point of said steel tube and said elastomer; thus, it is easy for the steel tube and elastomer structures to age and be impaired.

Thus, there are foregoing drawbacks of conventional elastic structure of physical training device in prior art to be improved.

SUMMARY OF THE PRESENT INVENTION

To overcome the existing problems of prior art, present invention provides an elasticity adjustment structure of physical training device, which may adjust its elasticity in accordance with different needs; and makes the elastic curve more smooth so stress is not over concentrated on certain point, the load of materials is reduced thus also reduces cost. Product safety and reliability are improved as well.

The present invention discloses an elasticity adjustment structure of physical training device, which comprises one elastomer adjustment set; and said elastomer adjustment set further comprises one relatively soft first elastomer and at least one relatively hard second elastomer. By changing the overlapping area of these two elastomers with different softness, the elasticity of the elasticity adjustment structure may be adjusted.

Wherein, said first elastomer is an elastic object further comprises one first junction and at least one second junction; said first junction is located on one end of said first elastomer and connected and fixed to one end of one connecting rod; said second junction is located on the other end of said first elastomer and connected and fixed to another connecting rod or one base. Said second elastomer is an elastic object with higher rigidity than said first elastomer, and can be adjusted to installation positions with different depths of said first elastomer so that the elasticity of said elasticity adjustment structure may be adjusted in accordance with different needs and that the elastic curve is smooth. Said second elastomer further comprises at least one first junction and at least one second junction; said first junction is located on one end of said second elastomer and installed to said first elastomer; said second junction is located on the other end of said second elastomer and fixed to said connecting rod or connected to another connecting rod at different location, so the depth position on said first elastomer which said first junction of second elastomer is installed can be adjusted to change the elasticity of said elasticity adjustment structure.

Preferably, said first elastomer comprises at least one fin-shaped vane section located on the side of said first elastomer. Said second elastomer may be installed inside or outside said first elastomer. When said second elastomer is installed outside said first elastomer, said first elastomer comprises at least one fin-shaped vane section located on the side to support horizontal force. While being impacted by external force, the barycenter will be still inside said elastic structure. Said first junction of second elastomer may be installed on different depth positions of said vane section of first elastomer for adjusting elasticity to meet different demands When said second elastomer is installed inside said first elastomer, said first junction of second elastomer is installed to different depth positions of said first elastomer for adjusting elasticity of said elastic structure to meet different demands.

DETAILED DESCRIPTION OF THE PREFERRED EMBODIMENT

The presently preferred embodiment and related aspects of the invention will now be described with reference to the accompanied drawings.

Please refer to FIGS. 1, 2, 3, 4, 5, 6, 7, 8, 9, 10, 11, 12, 13, 14, 15, 16, 17, 18, and 19 for different three-dimensional views and sectional views of different embodiments of elasticity adjustment structure of physical training device; wherein said elasticity adjustment structure comprise one elastomer adjustment set 10.

Figure 1:
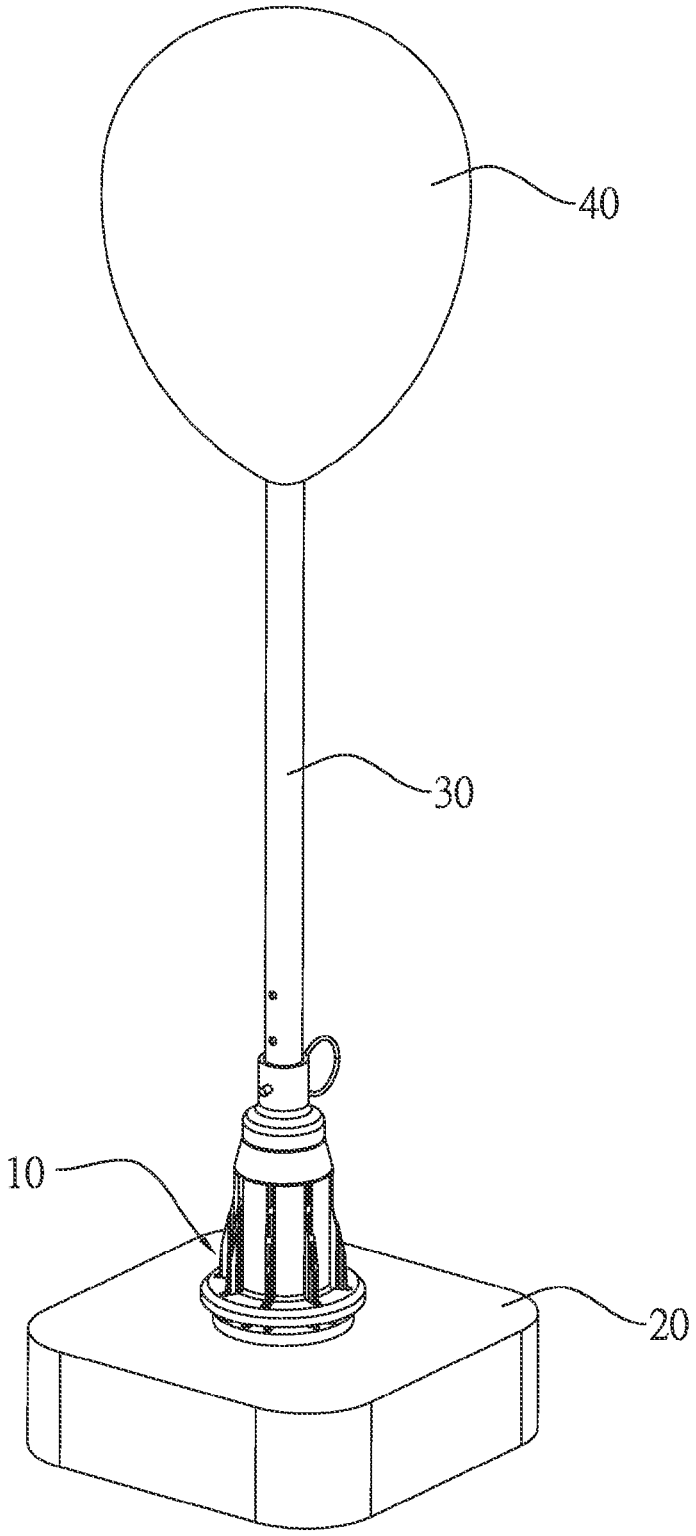
FIG. 1 is a three-dimensional view of embodiment A of present invention.
Figure 2:
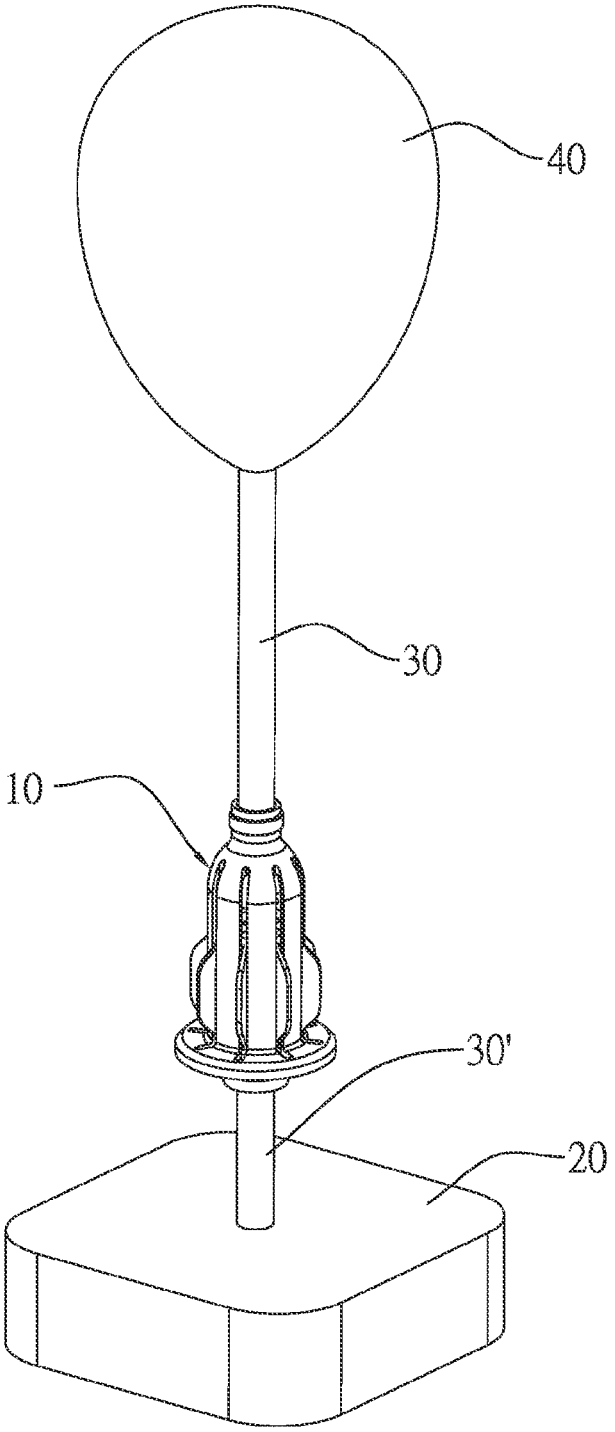
FIG. 2 is a three-dimensional view of embodiment B of present invention.
Figure 3:
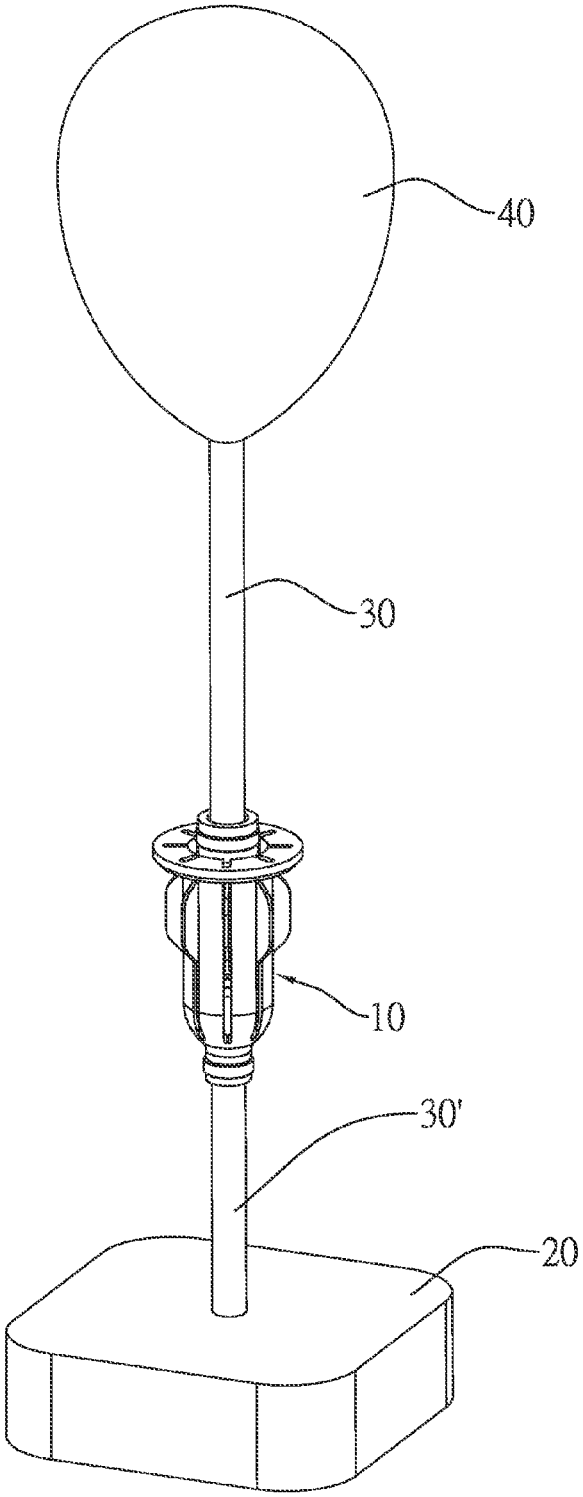
FIG. 3 is another three-dimensional view of embodiment B of present invention.
Figure 4:
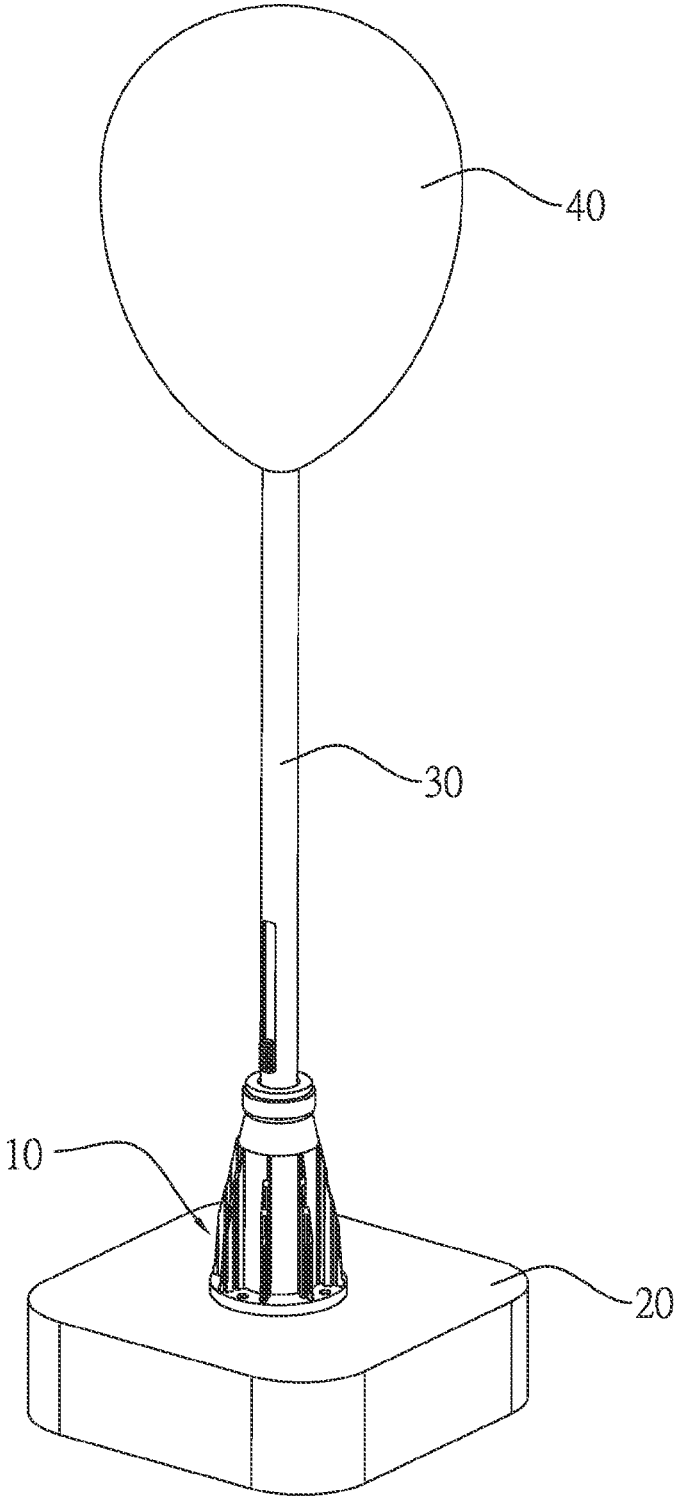
FIG. 4 is a three-dimensional view of embodiment C of present invention.
Figure 5:
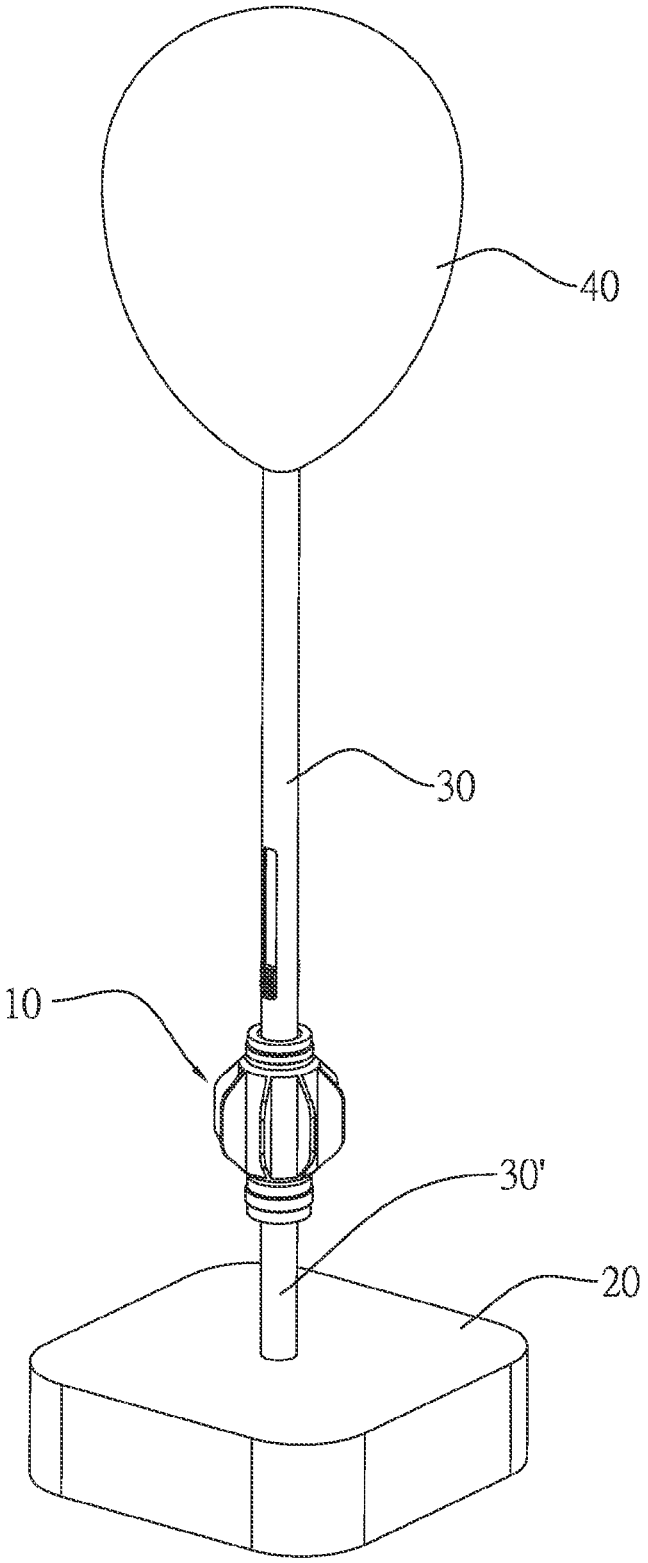
FIG. 5 is a three-dimensional view of embodiment D of present invention.
Figure 6:
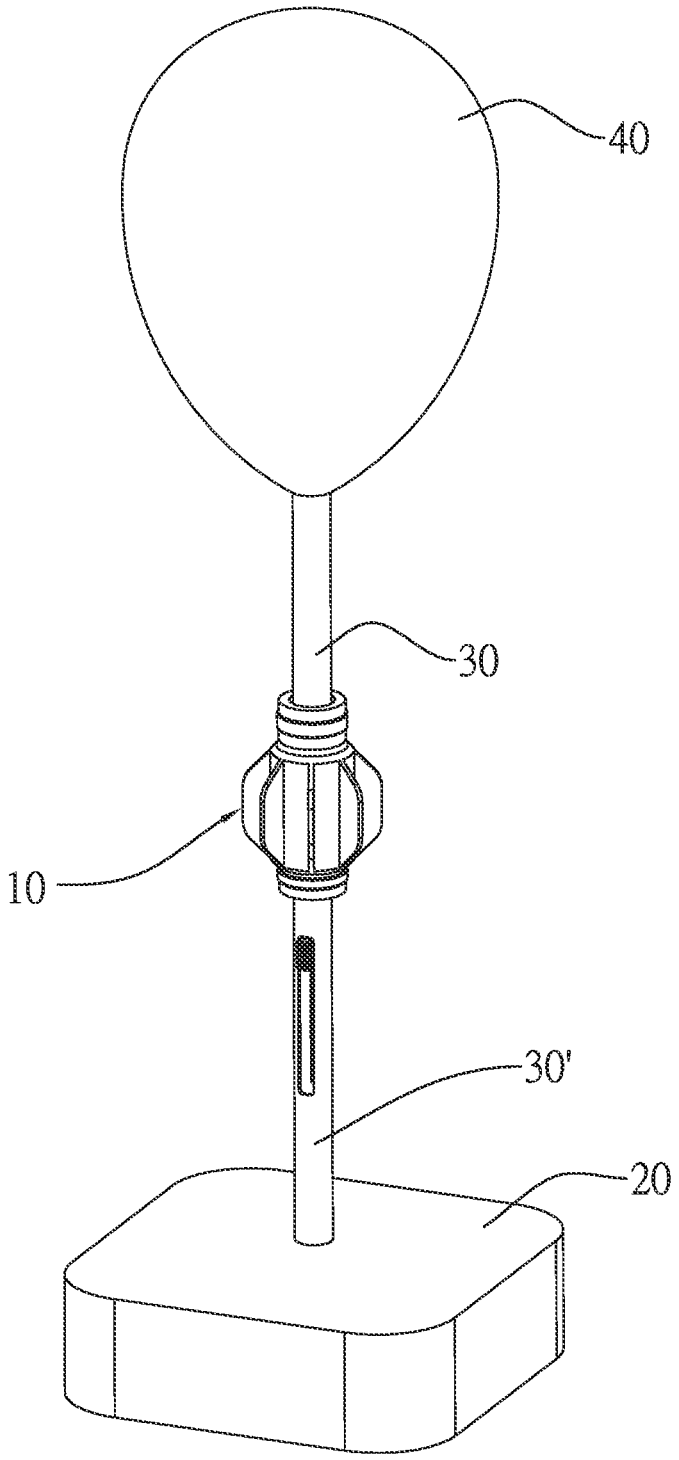
FIG. 6 is another three-dimensional view of embodiment D of present invention.
Figure 7:
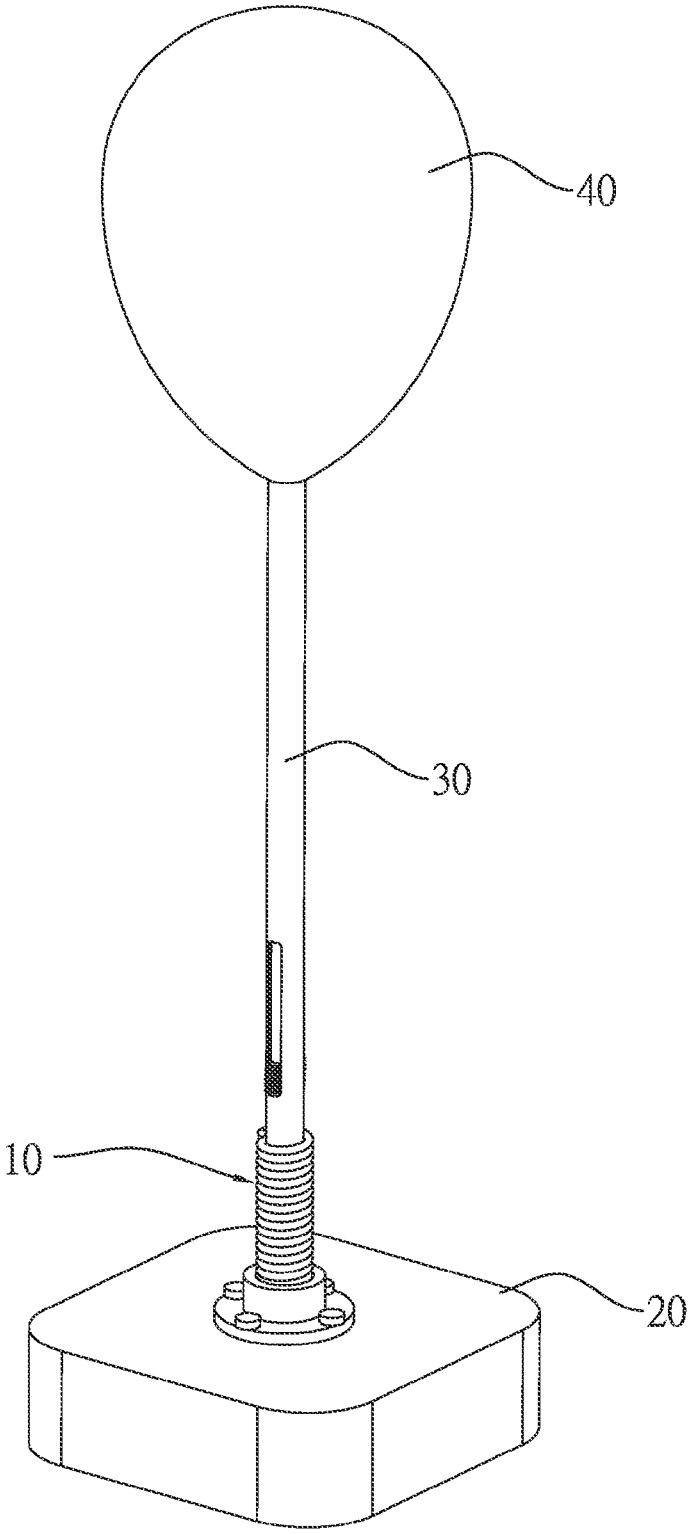
FIG. 7 is a three-dimensional view of embodiment E of present invention.
Figure 8:
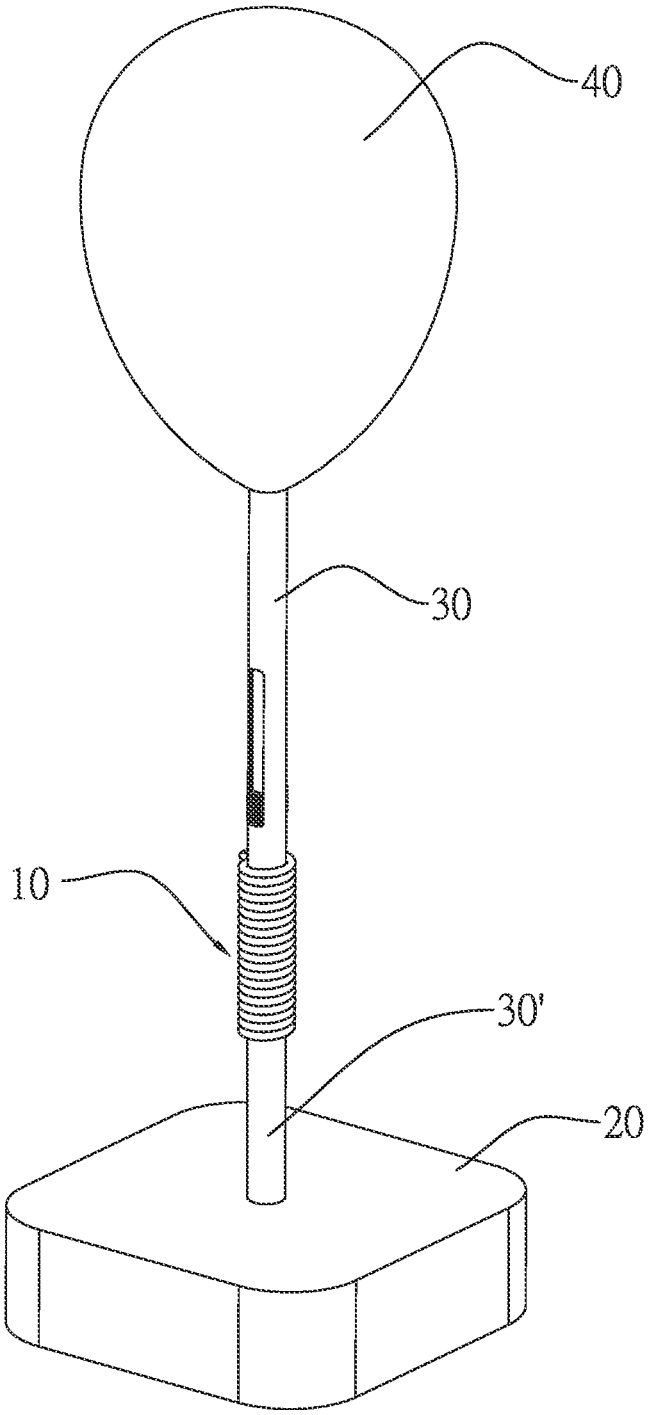
FIG. 8 is a three-dimensional view of embodiment F of present invention.
Figure 9:
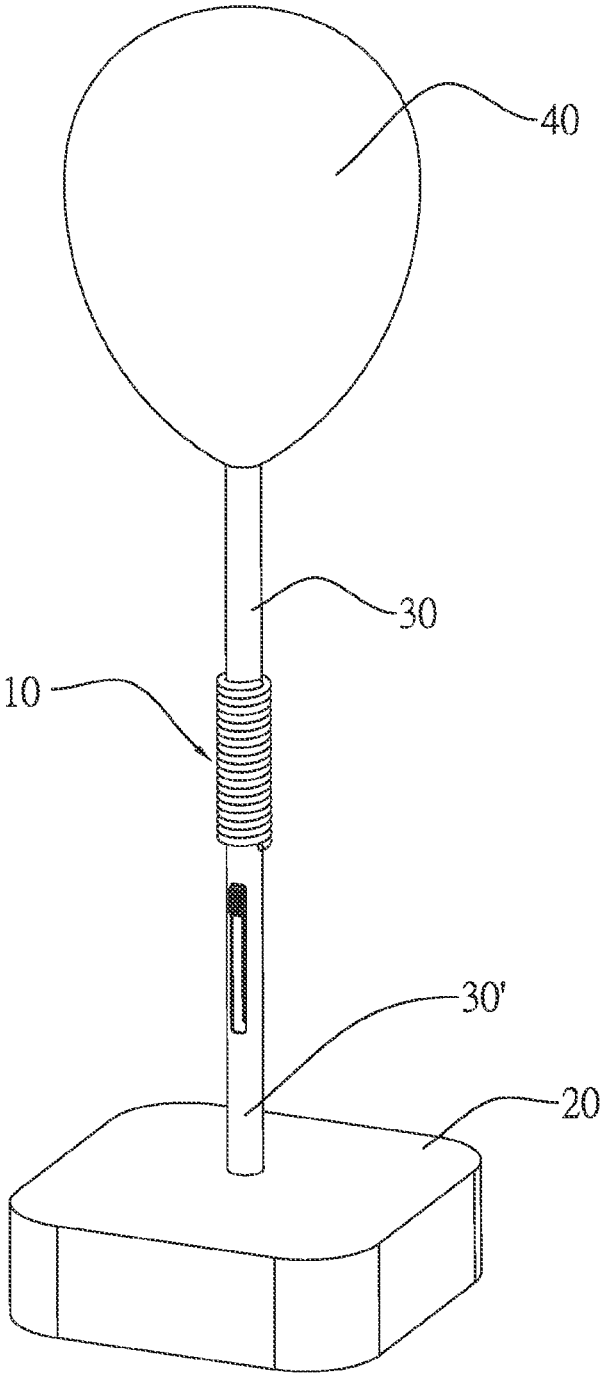
FIG. 9 is another three-dimensional view of embodiment F of present invention.

As shown in FIG. 1, 4, or 7, one end of connecting rod 30 is fixed and connected to one punching bag 40. The other end of said connecting rod 30 is fixed and connected to one end of said elastomer adjustment set 10. The other end of said elastomer adjustment set 10 is fixed and connected to one end of base 20.

As shown in FIG. 2, 3, 5, 6, 8 or 9, one end of connecting rod 30 is fixed and connected to one punching bag 40. The other end of said connecting rod 30 is fixed and connected to one end of said elastomer adjustment set 10. Another connecting rod 30' is fixed and connected to one base 20 with one end and to the other end of said elastomer adjustment set 10 with the other end.

Figure 16:
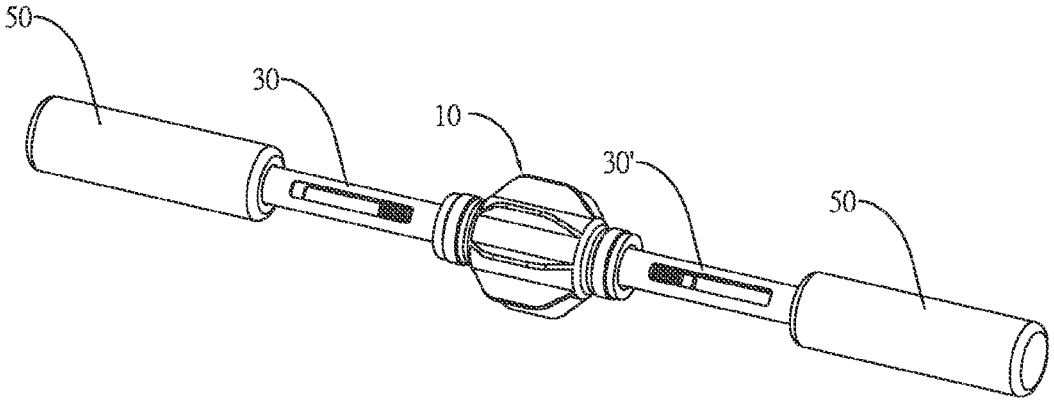
FIG. 16 is a three-dimensional view of embodiment G of present invention.
Figure 17:
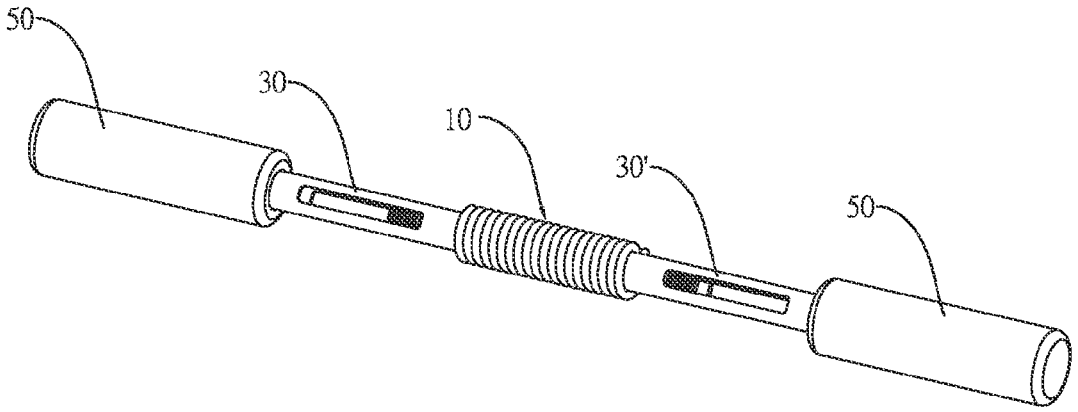
FIG. 17 is a three-dimensional view of embodiment H of present invention.

As shown in FIG. 16 or 17, one end of connecting rod 30 is fixed and connected to one handle 50. The other end of said connecting rod 30 is fixed and connected to one end of said elastomer adjustment set 10. The other connecting rod 30' is fixed and connected to one handle 50 with one end and to the other end of said elastomer adjustment set 10 with the other end.

Said elastomer adjustment set 10 further comprises one first elastomer 11 and at least one second elastomer 12.

Wherein, said first elastomer 11 is an elastic object and further comprises one first junction 112 and at least one second junction 113; said first junction 112 is located on one end of said first elastomer 11 while said second junction 113 is located on the other end of said first elastomer 11. Said second elastomer 12 is an elastic object with higher rigidity than said first elastomer 11. Said second elastomer 12 further comprises one first junction 121 and at least one second junction 122; said first junction 121 is located on one end of said second elastomer 12 while said second junction 122 is located on the other end of said second elastomer 12.

Said first junction 112 of first elastomer 11 is fixed and connected to the other end of said connecting rod 30; said second junction 113 of said first elastomer 11 is fixed and connected to said connecting rod 30' (as shown in FIG. 2, 3, 5, 6, 8, 9, 16, or 17) or said base 20 (as shown in FIG. 1, 4, or 7); said first junction 121 of said second elastomer 12 is installed to said first elastomer 11; said second junction 122 of said second elastomer 12 may be fixed and connected to said connecting rod 30 or different position of said connecting rod 30' in order to adjust the depth position on said first elastomer 11 which said first junction 121 of said second elastomer 12 is installed.

Figure 10:
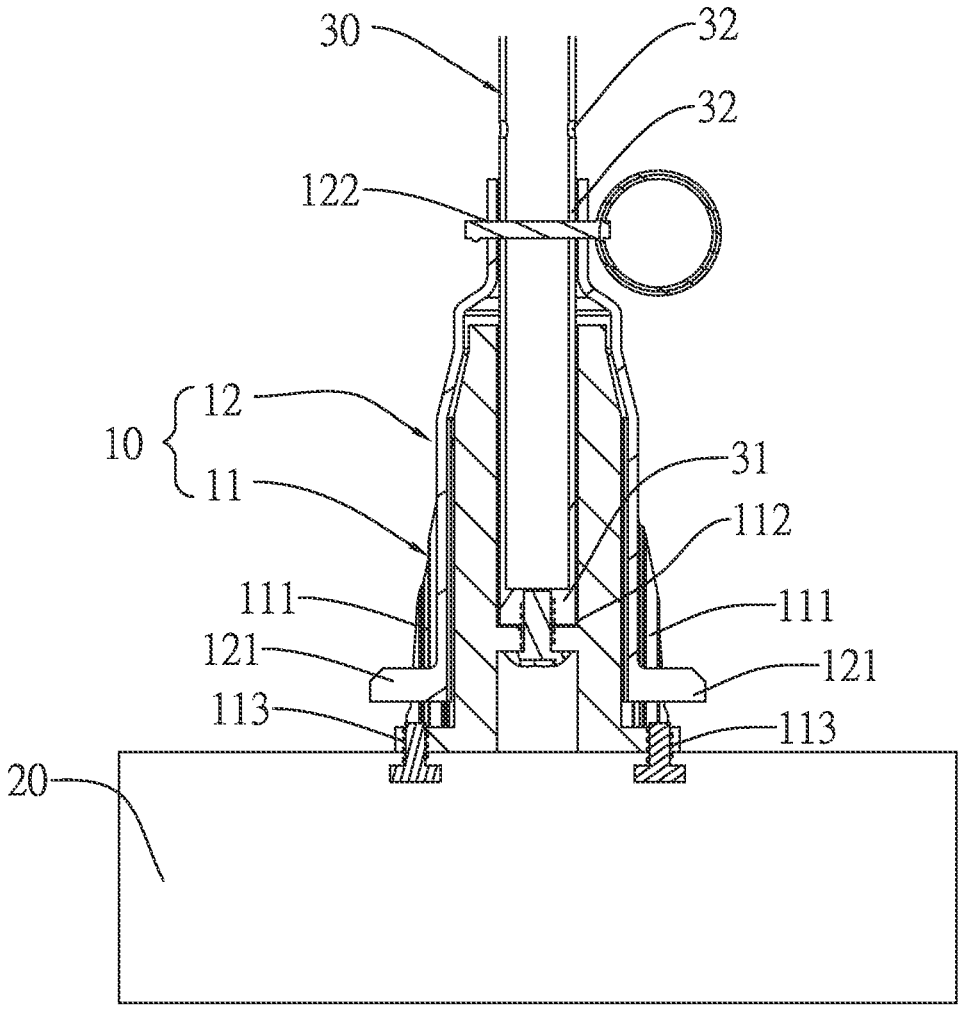
FIG. 10 is a sectional view of embodiment A of present invention.

As shown in FIG. 10, said second elastomer 12 may be installed outside said first elastomer. Wherein, said first elastomer 11 has at least one fin-shaped vane section 111 located on the side. Said first junction 121 of said second elastomer 12 is installed on said vane section 111 of first elastomer 11; one end of said connecting rod 30 comes with one first junction 31 and at least one second junction 32. Said first junction 31 of connecting rod 30 is fixed and connected to said first junction 112 of first elastomer 11;

said second junction 113 of first elastomer 113 is fixed and connected to said base 20. Said second junction 122 of second elastomer 12 may be fixed and connected to said second junction 32 of connecting rod 30 at different positions so that the said first junction 121 of second elastomer 12 is installed on said vane section 111 of first elastomer 11 at different depth positions. Thus, the elasticity of said elasticity adjustment structure may be adjusted.

Figure 11:
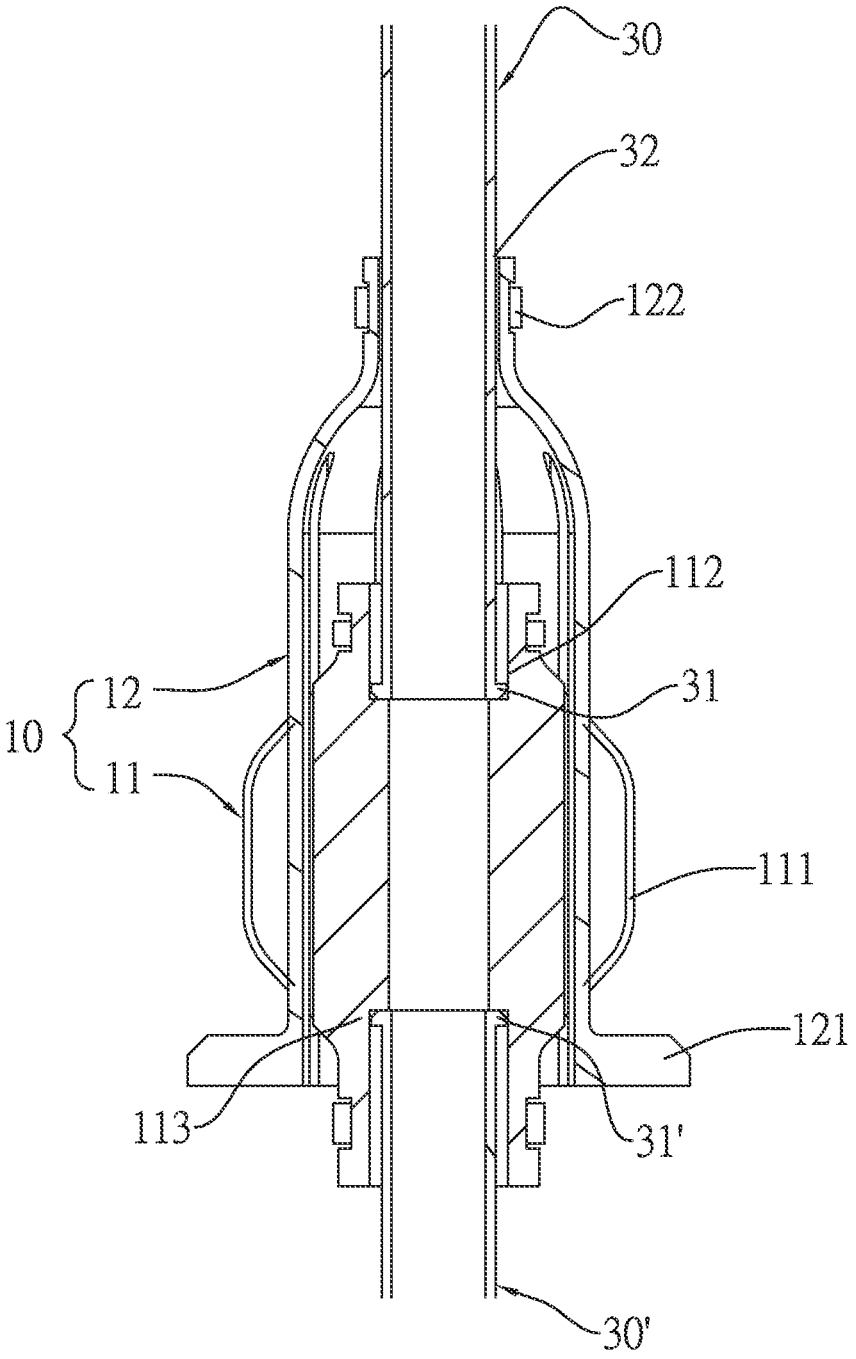
FIG. 11 is a sectional view of embodiment B of present invention.

As shown in FIG. 11, said second elastomer 12 may be installed outside said first elastomer. Wherein, said first elastomer 11 has at least one fin-shaped vane section 111 located on the side. Said first junction 121 of said second elastomer 12 is installed on said vane section 111 of first elastomer 11; one end of said connecting rod 30 comes with one first junction 31 and at least one second junction 32. Said first junction 31 of connecting rod 30 is fixed and connected to said first junction 112 of first elastomer 11; one end of said connecting rod 30' comes with one first junction 31'; said second junction 113 of first elastomer 11 is fixed and connected to said first junction 31' of connecting rod 30'. Said second junction 122 of second elastomer 12 may be fixed and connected to said second junction 32 of connecting rod 30 at different positions so that the said first junction 121 of second elastomer 12 is installed on said vane section 111 of first elastomer 11 at different depth positions. Thus, the elasticity of said elasticity adjustment structure may be adjusted.

Figure 12:
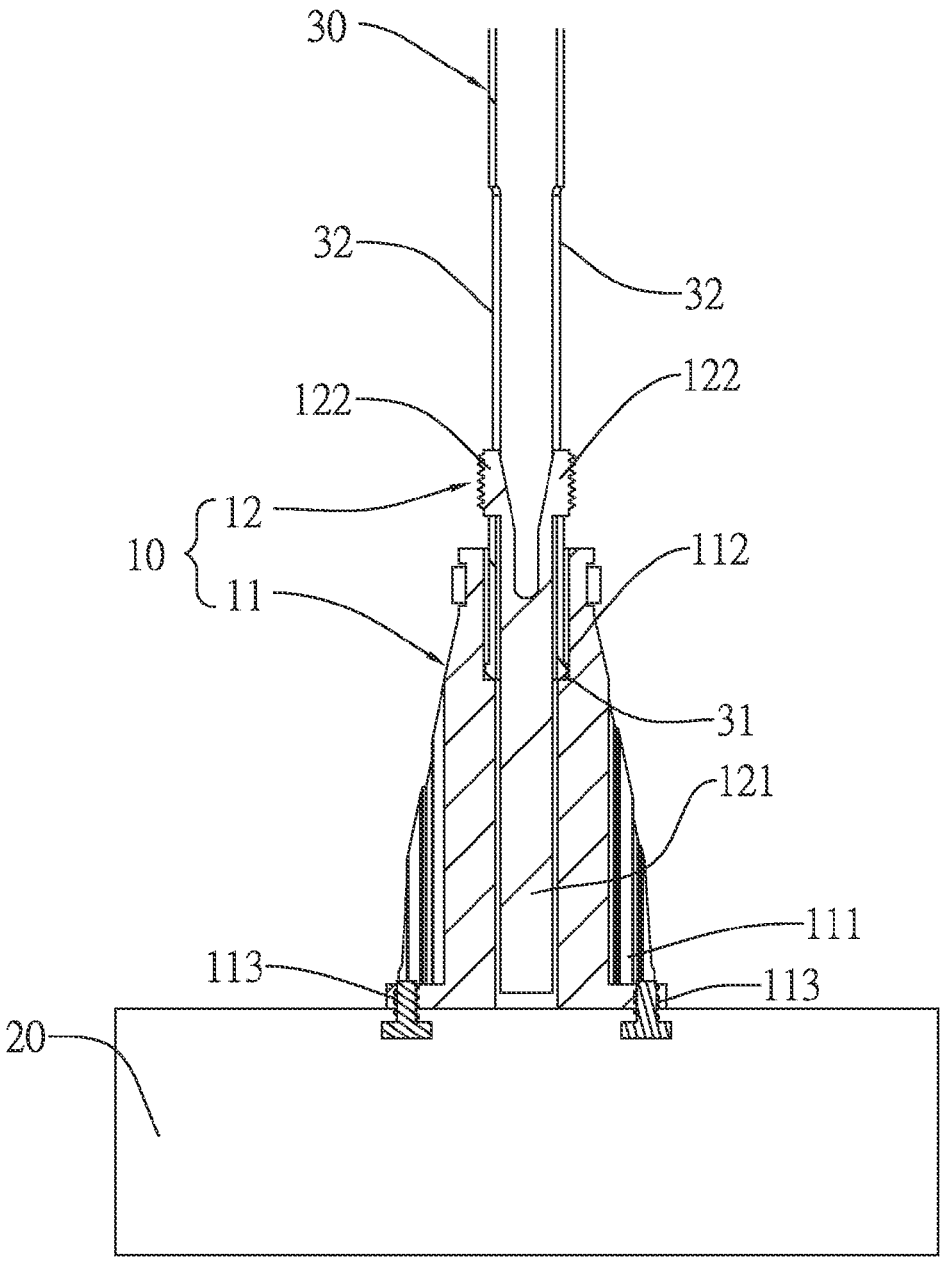
FIG. 12 is a sectional view of embodiment C of present invention.
Figure 14:
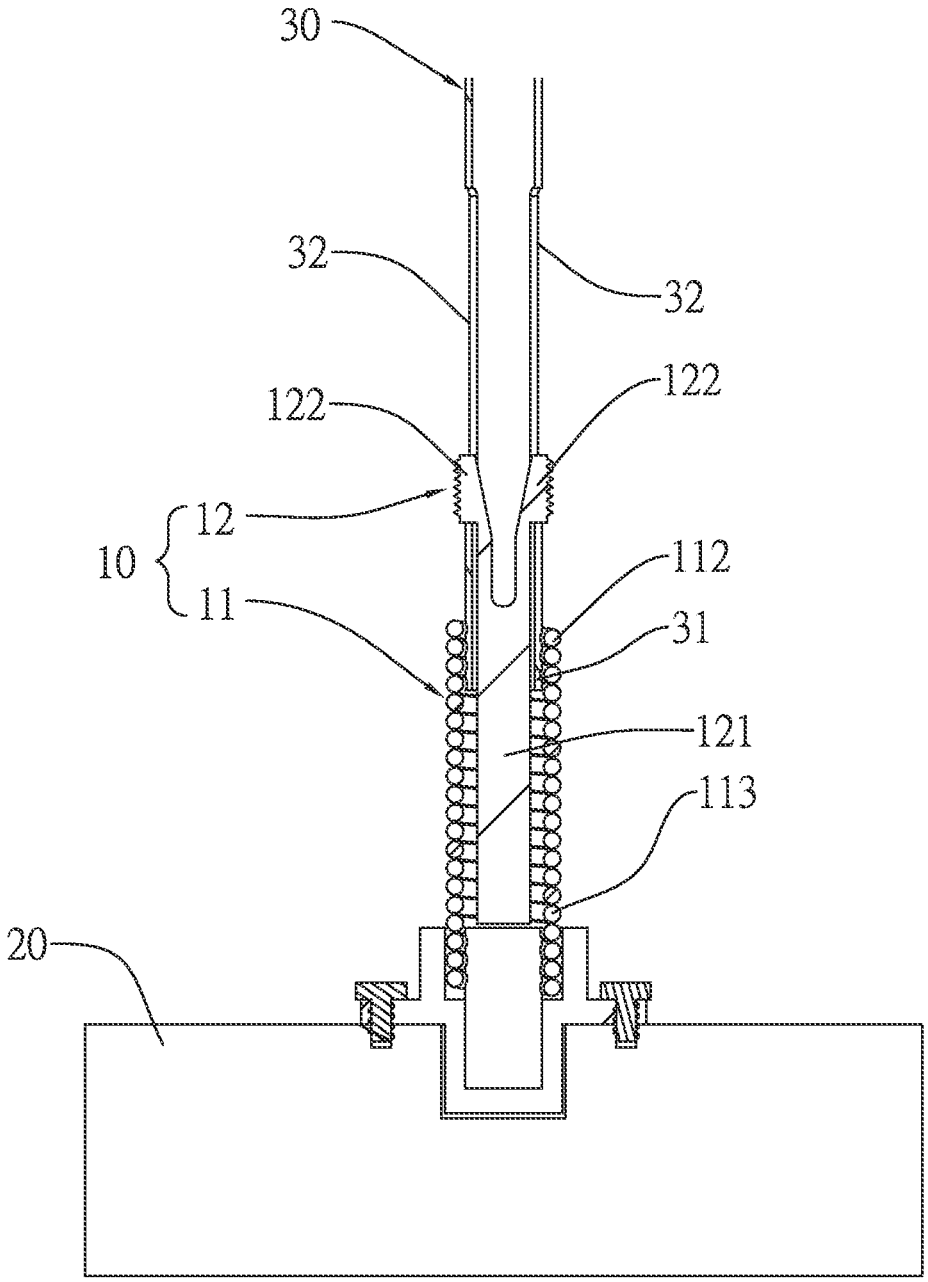
FIG. 14 is a sectional view of embodiment E of present invention.

As shown in FIG. 12 or 14, said second elastomer 12 may be installed inside first elastomer 11. Wherein, said first junction 121 of second elastomer 12 is installed inside said first elastomer 11; one end of said connecting rod 30 comes with one first junction 31 and at least one second junction 32. Said first junction 31 of connecting rod 30 is fixed and connected to said first junction 112 of first elastomer 11; said second junction 113 of first elastomer 113 is fixed and connected to said base 20. Said second junction 122 of second elastomer 12 may be fixed and connected to said second junction 32 of connecting rod 30 at different positions so that the said first junction 121 of second elastomer 12 is installed inside said first elastomer 11 at different depth positions. Thus, the elasticity of said elasticity adjustment structure may be adjusted.

Figure 13:
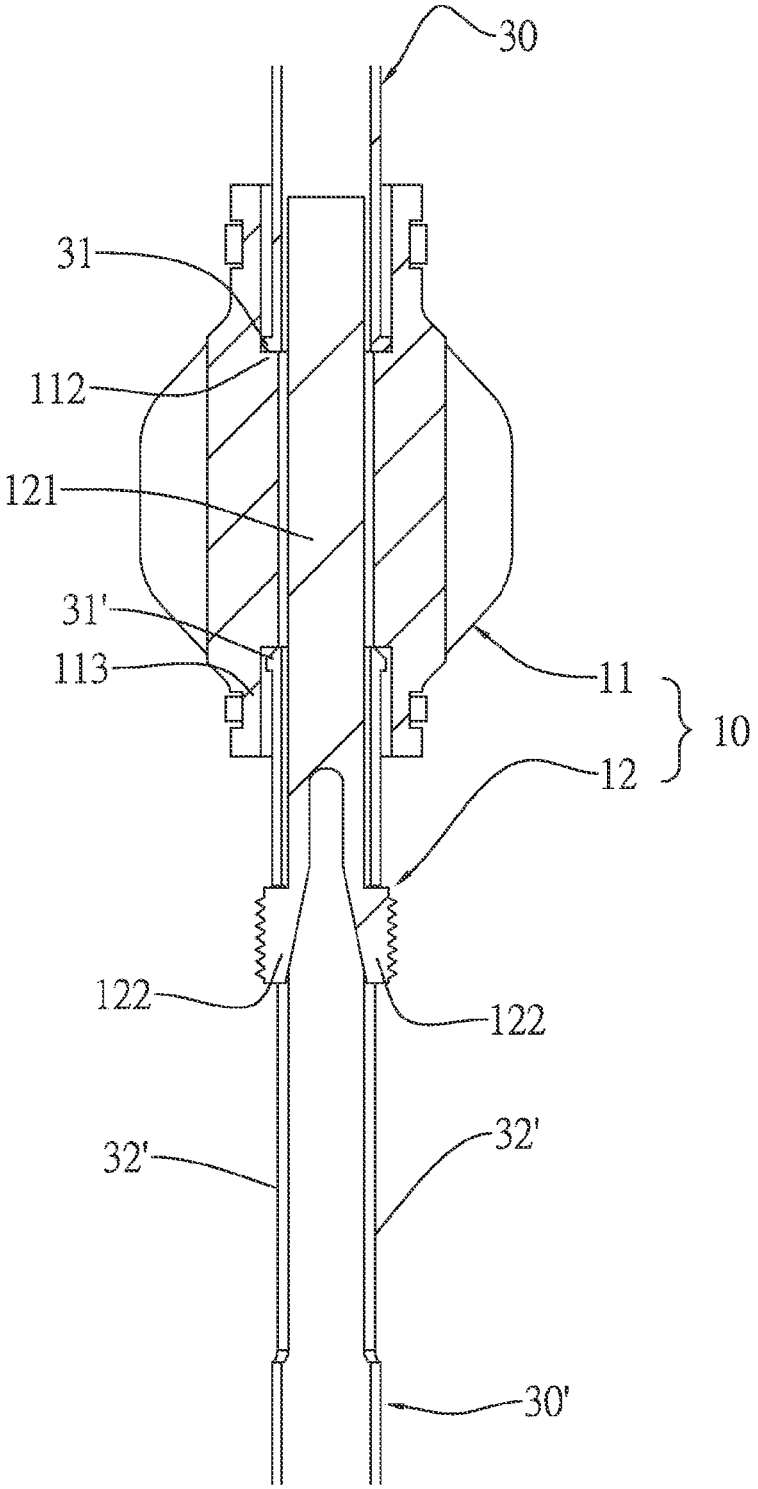
FIG. 13 is a sectional view of embodiment D of present invention.

As shown in FIG. 13, said second elastomer 12 may be installed inside first elastomer 11. Wherein, said first junction 121 of second elastomer 12 is installed inside said first elastomer 11; the end of said connecting rod 30 comes with one first junction 31.

Said first junction 31 of connecting rod 30 is fixed and connected to said first junction 112 of first elastomer 11; one end of said connecting rod 30' comes with one first junction 31' and one second junction 32'; said second junction 113 of first elastomer 11 is fixed and connected to said first junction 31' of connecting rod 30'. Said second junction 122 of second elastomer 12 may be fixed and connected to said second junction 32' of connecting rod 30' at different positions so that the said first junction 121 of second elastomer 12 is installed inside said first elastomer 11 at different depth positions. Thus, the elasticity of said elasticity adjustment structure may be adjusted.

Figure 15:
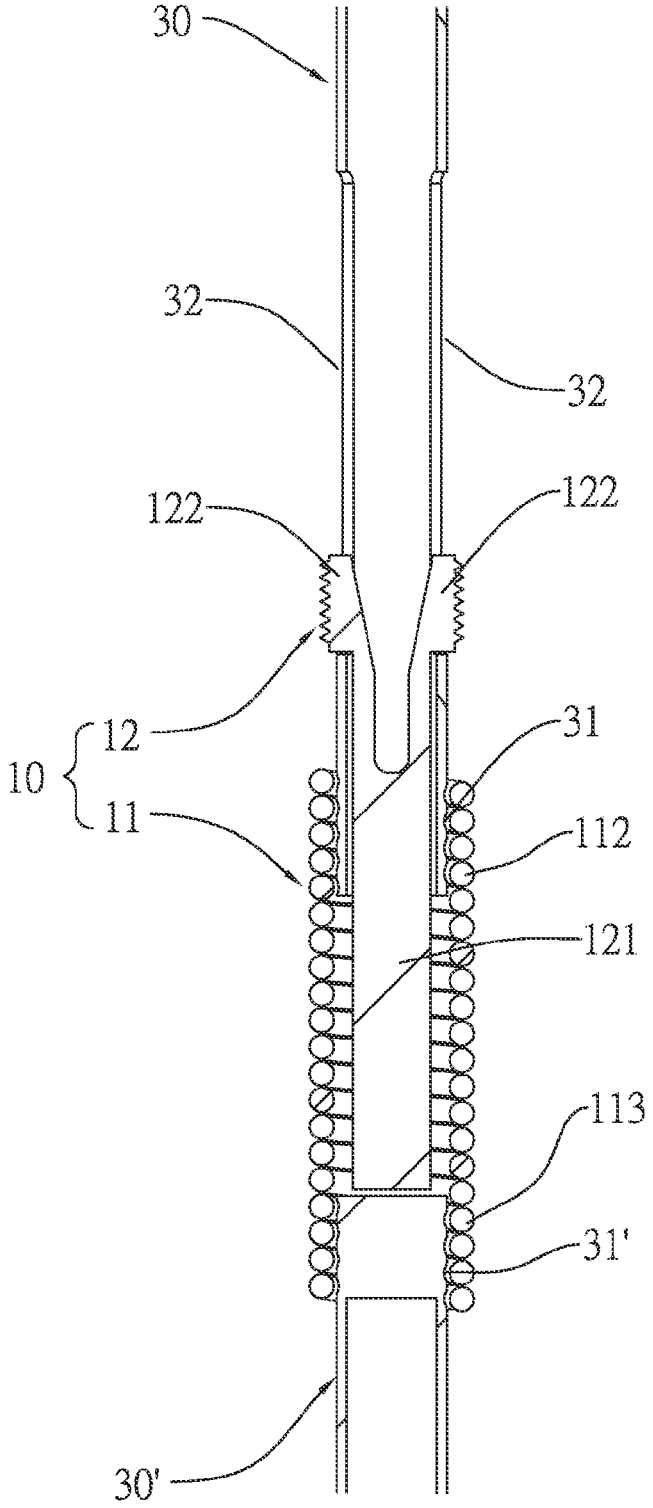
FIG. 15 is a sectional view of embodiment F of present invention.

As shown in FIG. 15, said second elastomer 12 may be installed inside first elastomer 11. Wherein, said first junction 121 of second elastomer 12 is installed inside said first elastomer 11; one end of said connecting rod 30 comes with one first junction 31 and at least one second junction 32. Said first junction 31 of connecting rod 30 is fixed and connected to said first junction 112 of first elastomer 11; one end of said connecting rod 30' comes with one first junction 31'; said second junction 113 of first elastomer 11 is fixed and connected to said first junction 31' of connecting rod 30'. Said second junction 122 of second elastomer 12 may be fixed and connected to said second junction 32 of connecting rod 30 at different positions so that the said first junction 121 of second elastomer 12 is installed inside said first elastomer 11 at different depth positions. Thus, the elasticity of said elasticity adjustment structure may be adjusted.

Said first junction 112 of first elastomer 11 is fixed and connected to one end of said connecting rod 30; said second junction 113 of said first elastomer 11 is fixed and connected to said connecting rod 30' (as shown in FIG. 16, or 17); said first junctions 121 of said second elastomers 12 are installed inside said first elastomer 11; each said second junction 122 of said second elastomers 12 is fixed and connected respectively to different positions of said connecting rod 30 and said connecting rod 30' in order to adjust the depth positions of said first junctions 121 of said second elastomers 12 installed on said first elastomer 11.

Figure 18:
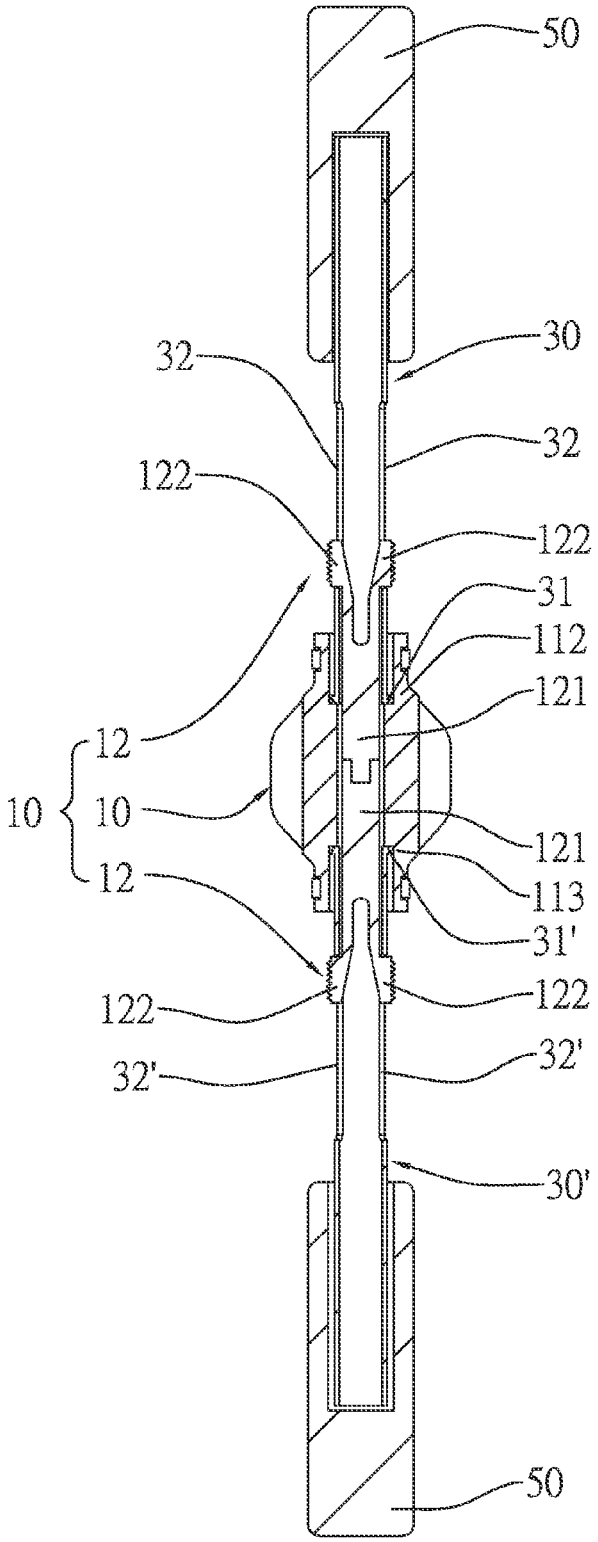
FIG. 18 is a sectional view of embodiment G of present invention.

As shown in FIG. 18, each said second elastomer 12 may be installed inside first elastomer 11. Wherein, each said first junction 121 of second elastomers 12 is installed inside said first elastomer 11; one end of said connecting rod 30 comes with one first junction 31 and at least one second junction 32. Said first junction 31 of connecting rod 30 is fixed and connected to said first junction 112 of first elastomer 11; one end of said connecting rod 30' comes with one first junction 31' and at least one second junction 32'; said second junction 113 of first elastomer 11 is fixed and connected to said first junction 31' of connecting rod 30'. Each said second junction 122 of second elastomers 12 is fixed and connected respectively to said second junction 32 of connecting rod 30 and second junction 32' of connecting rod 30' at different positions so that the said first junction 121 of second elastomers 12 is installed inside said first elastomer 11 at different depth positions. Thus, the elasticity of said elasticity adjustment structure may be adjusted.

Figure 19:
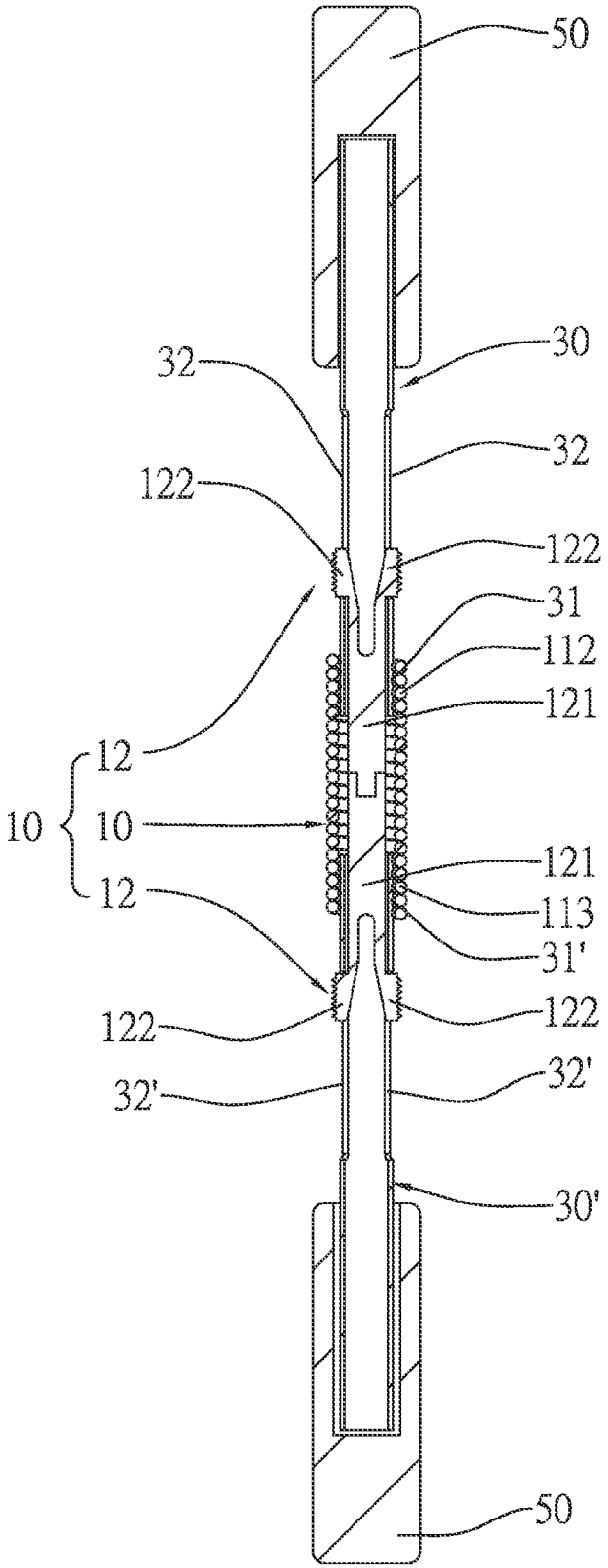
FIG. 19 is a sectional view of embodiment H of present invention.

As shown in FIG. 19, each said second elastomer 12 may be installed inside first elastomer 11. Wherein, each said first junction 121 of second elastomers 12 is installed inside said first elastomer 11; one end of said connecting rod 30 comes with one first junction 31 and at least one second junction 32. Said first junction 31 of connecting rod 30 is fixed and connected to said first junction 112 of first elastomer 11; one end of said connecting rod 30' comes with one first junction 31' and at least one second junction 32'; said second junction 113 of first elastomer 11 is fixed and connected to said first junction 31' of connecting rod 30'. Each said second junction 122 of second elastomers 12 is fixed and connected respectively to said second junction 32 of connecting rod 30 and second junction 32' of connecting rod 30' at different positions so that the said first junction 121 of second elastomers 12 is installed inside said first elastomer 11 at different depth positions. Thus, the elasticity of said elasticity adjustment structure may be adjusted.

Joining said second elastomer 12 and said first elastomer 11 with different rigidity at different depth positions to create different overlapping area so that the elastomer adjustment set 10 may create a smooth elastic curve and hence elasticity of the said elasticity adjustment structure may be adjusted.

Although the present invention has been explained in relation to its preferred embodiment, it is to be understood that many other possible modifications and variations can be made without departing from the scope of the invention as hereinafter claimed.

What is claimed is:

1. An elasticity adjustment structure of physical training device, comprising:

a punching bag;

a base;

a first connecting rod, wherein a top end of said first connecting rod is coupled at said punching bag, wherein a first rod junction of said first connecting rod is defined at a bottom end of said first connecting rod and a second rod junction is defined above said first rod junction;

a second connecting rod, wherein a bottom end of said second connecting rod is upwardly extended from said base;

an elastomer adjustment set, which is coupled between said first connecting rod and said second connecting rod, wherein said elastomer adjustment set comprises:

a tubular first elastomer, wherein a first junction of said first elastomer is connected to said first rod junction of said first connecting rod, and a second junction of said first elastomer is connected to said second connecting rod;

a tubular second elastomer, which has a rigidity higher than said first elastomer, wherein said second elastomer has a first junction and a second junction extended above said first junction of said second elastomer, wherein said first junction of said second elastomer, which is a bottom end portion of said second elastomer, is sleeved with said first elastomer and is arranged above said second connecting rod that there is no connection between said first junction of said second elastomer and said second connecting rod, and said second junction of said second elastomer is selectively coupled with said second rod junction of said first connecting rod at one of different depth positions to define an overlapping area between said first and second elastomers, wherein different depth positions of said first junction of said second elastomer on said first elastomer are provided to provide a size of said overlapping area between said first and second elastomers, wherein said size of said overlapping area between said first and second elastomers is adjustable according to said different depth positions of said first junction of said second elastomer on said first elastomer to provide different elasticities of said elastomer adjustment set.

2. The elasticity adjustment structure, as recited in claim 1, wherein said second elastomer is sleeved inside said first elastomer.

3. An elasticity adjustment structure of physical training device, comprising:

a punching bag;

a base;

a first connecting rod having a bottom end and a top end coupled at said punching bag;

a second connecting rod having a top end and a bottom end upwardly extended from said base; and an elastomer adjustment set comprising a tubular first elastomer and a tubular second elastomer, wherein said first elastomer has a first junction and a second junction at two opposite ends thereof, wherein said first junction of said first elastomer is connected to said bottom end of said first connecting rod, wherein said second junction of said first elastomer is connected to said top end of said second connecting rod, wherein said second elastomer, which is arranged above said second connecting rod and has a rigidity higher than said first elastomer, has a first junction and a second junction at two opposite ends thereof, wherein said first junction of said second elastomer is sleeved with said first elastomer in such a manner that an overlapping area is defined between said first elastomer and said second elastomer, wherein said second junction of said second elastomer is detachably coupled at said first connecting rod in such a manner that said second junction of said second elastomer is capable of being detached and fixed at different positions above said bottom end of said first connecting rod along a height of said first connecting rod to change a size of said overlapping area between said first elastomer and said second elastomer, wherein said elastomer adjustment set provides different elastic strengths and said punching bag is capable of swinging back and forth with different amplitudes.

4. The elasticity adjustment structure, as recited in claim 3, wherein said second elastomer is sleeved inside said first elastomer.

* * * * *